US007173402B2

(12) United States Patent
Chen et al.

(10) Patent No.: US 7,173,402 B2
(45) Date of Patent: Feb. 6, 2007

(54) LOW DROPOUT VOLTAGE REGULATOR

(75) Inventors: Jiwei Chen, Santa Clara, CA (US); Guoxing Li, Sunnyvale, CA (US)

(73) Assignee: O2 Micro, Inc., Santa Clara, CA (US)

( * ) Notice: Subject to any disclaimer, the term of this patent is extended or adjusted under 35 U.S.C. 154(b) by 278 days.

(21) Appl. No.: 10/786,799

(22) Filed: Feb. 25, 2004

(65) Prior Publication Data

US 2005/0184711 A1 Aug. 25, 2005

(51) Int. Cl.
*G05F 1/44* (2006.01)
*G05F 3/16* (2006.01)

(52) U.S. Cl. ..... 323/280; 323/274; 323/316

(58) Field of Classification Search ..... 323/313, 323/314, 316, 274–281, 317; 327/539, 540
See application file for complete search history.

(56) References Cited

U.S. PATENT DOCUMENTS

| | | | | |
|---|---|---|---|---|
| 5,563,501 | A | 10/1996 | Chan | 323/282 |
| 5,889,393 | A | 3/1999 | Wrathall | 323/282 |
| 6,084,475 | A | 7/2000 | Rincon-Mora | 330/255 |
| 6,304,131 | B1 | 10/2001 | Huggins et al. | 327/538 |
| 6,373,233 | B2 | 4/2002 | Bakker et al. | 323/282 |
| 6,437,638 | B1 * | 8/2002 | Coles et al. | 327/540 |
| 6,518,737 | B1 | 2/2003 | Stanescu et al. | 323/280 |
| 6,965,218 | B2 * | 11/2005 | Scoones et al. | 323/280 |

OTHER PUBLICATIONS

Gabriel Alfonso Rincon-Mora, Texas Instruments Incorporated, Dallas, TX 75243, "Active Capacitor Multiplier in Miller-Compensated Circuits", pp. 1-16, no date.

* cited by examiner

*Primary Examiner*—Jessica Han

(57) ABSTRACT

A low dropout voltage regulator (LDO) includes a regulating circuit, an amplifier, and a first compensating path. The regulating circuit is configured to receive an input signal at an input terminal and provide an output signal at an output terminal in response to a control signal received at the control terminal. The amplifier may have a first input terminal coupled to a first input path and an output terminal be coupled to the control terminal of the regulating circuit via a path to provide the control signal. The first compensating path is coupled between a first node on the first input path and a first node on the path coupling the output terminal of the amplifier to the control terminal of the regulating circuit, the first compensating path including a first compensating capacitor.

15 Claims, 5 Drawing Sheets

LOW DROPOUT VOLTAGE REGULATOR

FIELD

This disclosure relates to low dropout voltage regulators.

BACKGROUND

Low dropout voltage regulators (LDOs) may be utilized in a variety of electronic devices including, but not limited to, laptop computers, portable phones, personal digital assistants, and the like, to provide a regulated output voltage to a load. LDOs may be utilized when the regulated voltage level for a particular load of the electronic device is not available from a supply voltage source and/or the quality of the supply voltage is not high enough for the particular load. LDOs can typically provide such regulated output voltage with relatively little voltage drop across the LDO.

As a negative feedback system, LDOs typically require frequency compensation for stability. However, many prior art embodiments may utilize components, such as a capacitor, external to the LDO for such frequency compensation. Use of such external components may require at least a bonding pad, a conductor, and a pin and hence overall costs are increased. In addition, the external component requires space in an environment where there is a premium on such space. Some prior art compensation techniques have also found it difficult to provide stability over a wide range of source currents provided by the LDO.

BRIEF DESCRIPTION OF THE DRAWINGS

Features and advantages of embodiments of the claimed subject matter will become apparent as the following Detailed Description proceeds, and upon reference to the Drawings, where like numerals depict like parts, and in which:

Although the following Detailed Description will proceed with reference being made to illustrative embodiments, many alternatives, modifications, and variations thereof will be apparent to those skilled in the art. Accordingly, it is intended that the claimed subject matter be viewed broadly.

DETAILED DESCRIPTION

Figure 1:
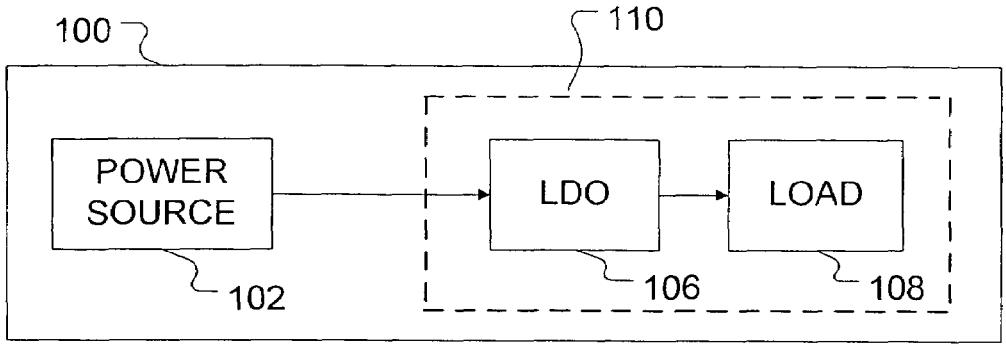
FIG. 1 is a block diagram of electronic device having an LDO.

Turning to FIG. 1, a simplified block diagram of an electronic device 100 having a power source 102, an LDO 106, and a load 108 is illustrated. The electronic device 100 may be a variety of devices such as a laptop computer, portable phone, personal digital assistant, and the like. The power source 102 may be a battery, e.g., a lithium battery, for providing unregulated DC voltage to the LDO 106. A variety of other components, e.g., a DC to DC converter, may be utilized between the power source 102 and the LDO 106. Although only one LDO 106 and associated load 108 is illustrated for clarity, a plurality of LDOs may be utilized in the electronic device 100 for serving any plurality of loads. The LDO 106 may also be integrated onto an integrated circuit (IC) 110 with the load 108. As used herein, an "integrated circuit" means a semiconductor device and/or microelectronic device, such as, for example, a semiconductor integrated circuit chip.

Figure 2:
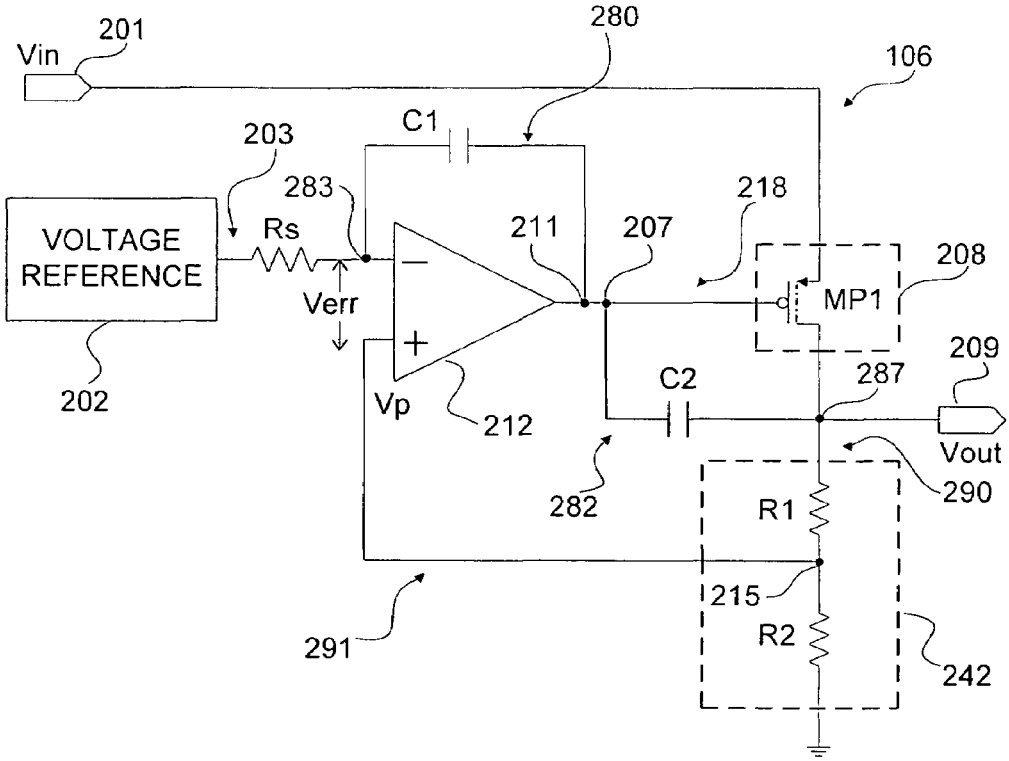
FIG. 2 is a circuit diagram of the LDO of FIG. 1.

Turning to FIG. 2, a block diagram of the LDO 106 of FIG. 1 is illustrated. The LDO 106 receives an input voltage at terminal 201 and provides a regulated output voltage at terminal 209. The LDO 106 may include a regulating circuit 208 and an amplifier 212. The regulating circuit 208 may have an input terminal that receives an input voltage signal from terminal 201, an output terminal that provides a regulated output voltage level at terminal 209, and a control terminal that accepts a control signal from the output of amplifier 212. The regulating circuit 208 may include a pass element such as a p-type metal oxide semiconductor field effect transistor (MOSFET) MP1 as illustrated in FIG. 2. Transistor MP1 may have its source coupled to input terminal 201 and its drain coupled to output terminal 209. The gate of transistor MP1 may be coupled to the output of amplifier 212 via path 218.

The amplifier 212 may be an operational transconductance amplifier (OTA). Amplifier 212 may have its inverting input coupled to input path 203 to receive a reference voltage signal. The reference voltage signal may be provided by a voltage reference source 202. A resistor Rs may also be coupled to the input path 203 between the voltage reference source 202 and the inverting input terminal of the amplifier 212. Amplifier 212 may have its other input or noninverting input coupled to node 215.

A feedback network 242 may be coupled between the drain of transistor MP1 and the noninverting input of amplifier 212. The feedback network may include resistors R1 and R2 forming a voltage divider to scale down the output voltage $V_{OUT}$ of the LDO 106 to a lower voltage level $V_P$ representative of the output voltage. Resistor R1 may be coupled between node 287 and node 215, while resistor R2 may be coupled between node 215 and ground such that $V_P = V_{OUT}(R2/R1+R2)$.

Advantageously, a first compensating path 280 may be coupled between nodes 283 and 211. Node 283 may be a junction point where the first compensating path 280 is coupled to the input path 203, and node 211 may be a junction point where the first compensating path 280 is coupled to the path 218. Path 218 couples the output of the amplifier 212 to the control terminal of transistor MP1. The first compensating path 280 may also include a first compensating capacitor C1. A second compensating path 282 may be coupled between nodes 287 and 207. Node 287 may be a junction point where the second compensating path 282 is coupled to a path 290. Path 290 is coupled to the drain of transistor MP1. Node 207 may be a junction point where the second compensating path 282 is coupled to path 218. The second compensating path 282 may also include a second compensating capacitor C2. The first C1 and second C2 compensating capacitors may be any available types of capacitors such as metal-insulator-metal (MIM), poly-insulator-poly (PIP), active MOS capacitors, etc.

In DC operation, the LDO 106 may provide a regulated output DC voltage at terminal 209. The feedback network 242 may provide a voltage level $V_P$ representative of the output voltage level at terminal 209 to the noninverting input terminal of the amplifier 212. The amplifier 212 may also receive a reference voltage signal at its inverting input terminal via input path 203. This reference voltage signal may be provided by any variety of sources including voltage reference source 202. In one embodiment, the voltage reference source 202 may be a bandgap circuit.

The amplifier 212 may function as an error amplifier by comparing the reference voltage signal with the voltage level $V_P$ and provide an appropriate output control signal to the regulating circuit 212 via path 218 based on the difference between such voltage signals or the voltage error signal Verr. The regulating circuit 208 may be responsive to this control signal to make any necessary adjustments to drive the voltage error signal Verr as close to zero as possible by modifying the output voltage level $V_{OUT}$.

For instance, if the output voltage $V_{OUT}$ at terminal 209 increases above a desired regulated voltage level, the voltage level $V_P$ also increases. Thus the error voltage Verr between the inputs of the amplifier 212 will cause the output voltage from the amplifier 212 as seen by the gate terminal of transistor MP1 to increase. As a result, the transistor MP1 will conduct less current which will reduce the output voltage to keep the output voltage stable. In contrast, if the output voltage $V_{OUT}$ at terminal 209 decreases below a desired regulated voltage level, the voltage level $V_P$ also decreases. Thus the error voltage Verr between the input of the amplifier 212 will cause the output voltage from the amplifier 212 as seen by the gate terminal of transistor MP1 to decrease. As a result, the transistor MP1 will conduct more current which will increase the output voltage to keep the output voltage stable.

The feedback signal provided to the noninverting input terminal of the amplifier 212 via path 291 may be a negative feedback signal. That is, the negative feedback signal may be opposite in polarity to the source signal received at the inverting input terminal. However, as the feedback signal travels around the feedback loop via paths 290, 291, phase shift may occur. Phase shift may be defined as the total amount of phase change that is introduced into the feedback signal as it travels around the feedback loop. Ideal negative feedback would be 180 degrees out of phase with the source signal. Any phase shift therefore from this ideal position may affect stability of the LDO depending on the magnitude of the phase shift. If the phase shift was 180 degrees from this ideal position (positive or negative) the feedback signal would be in phase with the source signal which would cause the LDO to be unstable. For stability of the LDO, the phase margin, defined as the difference in degrees between the total phase shift of the feedback signal and the ideal 180 degrees from the source signal at the unity gain frequency should be above a minimum level.

The stability of the LDO 106 may be may be affected by frequency compensation. The poles and zeroes of the transfer function of the LDO in the complex frequency domain represent its frequency response. A frequency response plot of loop gain (dB) versus frequency (Hertz) may be utilized to analyze the affects of poles and zeros. A pole location changes the slope of the gain curve by −20 dB/decade, while a zero location changes the slope of the gain curve by +20 dB/decade. The phase shift introduced by a pole or zero is frequency dependent and nearly all the phase shift added by a pole or zero occurs within a frequency range one decade above and one decade below the pole or zero frequency.

For the LDO 106, a first dominant pole occurs at a frequency level $f_{p1}$ given by equation (1).

$$f_{p1} = \frac{1}{2\pi[Rs(1+A)C_1 + r_{01}(1+B)C_2]} \tag{1}$$

In equation (1), $f_{p1}$ is the frequency level in Hertz of the first dominant pole. This $f_{p1}$ pole location is referred to as a "dominant" pole since it has a greater affect on the behavior of the LDO than the other pole and zero. The $R_S$ variable is the value of resistor $R_S$ coupled to the input path 203. The A variable is the voltage gain of amplifier 212. In one embodiment, the amplifier 212 is a high gain amplifier. The $r_{01}$ variable is the output impedance of the amplifier 212. The transistor MP1 and the feedback network 242 including the voltage divider formed by resistors R1 and R2 forms a second stage circuit which has a voltage gain of −B. The C1 variable is the value of the first compensating capacitor C1 of the first compensating path 280 and the C2 variable is the value of the second compensating capacitor C2 of the second compensating path 282.

Resistor $R_S$ and capacitor C1 introduce a zero at a frequency level given by equation (2) where variables $R_S$ and C1 are similar to those variables of equation (1).

$$f_{z1} = \frac{1}{2\pi R_S C_1} \tag{2}$$

A second parasitic pole is generated at a frequency level given by equation (3) where all the variables are similar to those previously defined relative to equation (1).

$$f_{p2} \approx \frac{1}{2\pi}\left[\frac{1}{R_S C_1} + \frac{(1+A)}{(1+B)} \cdot \frac{1}{r_{01} C_2}\right] = f_{z1} + \frac{1}{2\pi}\frac{(1+A)}{(1+B)} \cdot \frac{1}{r_{01} C_2} \tag{3}$$

As is detailed in equations (1) through (3), the LDO 106 introduces the zero $f_{z1}$ at a frequency level slightly less than the frequency level of the second parasitic pole $f_{p2}$ thus partially canceling the affect of the second parasitic pole and increasing the phase margin.

Figure 3:
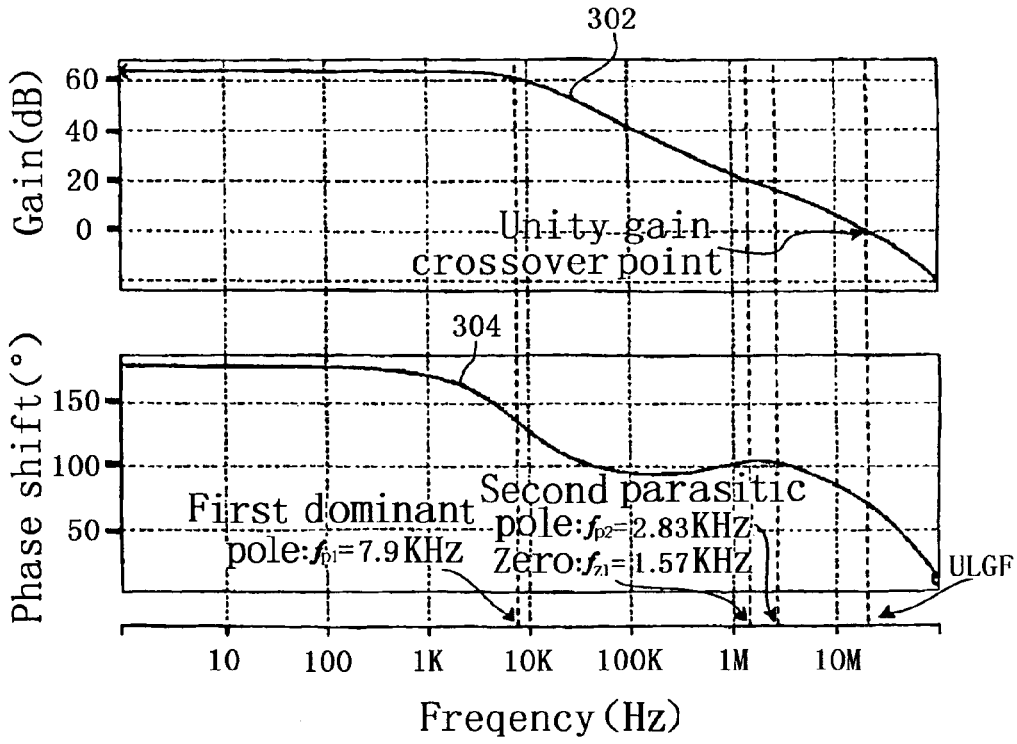
FIG. 3 is a graph of an exemplary gain curve plot and associated phase shift plot over the same frequency range showing exemplary pole and zero locations of one embodiment of the LDO of FIG. 2.

FIG. 3 illustrates the frequency response of one embodiment of the LDO of FIG. 2 where $R_S$=110 kilo-ohms (kΩ), R1=1 kΩ, R2=33 kΩ, C1=C2=0.9 picofarads (pF), A=115, B=14, r01=500 kΩ, Vin=5V, and Vout=3.3V. At these particular variable values, the first dominant pole $f_{p1}$ occurs at 7.9 kilohertz (kHz), the zero $f_{z1}$ occurs at 1.57 megahertz (MHz), and the second parasitic pole $f_{p2}$ occurs at 2.83 MHz.

The gain curve plot 302 has a slope that decreases at 20 dB/decade starting at the location of the first dominant pole $f_{p1}$ at 7.9 kHz. Advantageously, the zero $f_{z1}$ at 1.57 MHz is sufficiently close to the parasitic pole $f_{p2}$ at 2.83 MHz such that the +20 dB/decade slope introduced by the zero is offset by the −20 dB/decade slope introduced by the parasitic pole to effectively cancel one another. Therefore, the gain curve plot 302 may effectively have a negative 20 dB/decade slope from about 7.9 kHz to the unity loop gain frequency (ULGF) of about 21 MHz in this embodiment. The ULGF is the frequency level when the loop gain is equal to 0 dB. In other words, the gain curve plot 302 may effectively act like a one pole system.

The phase shift plot 304 is affected by the location of the first dominant pole $f_{p1}$ by reducing the phase shift by about 45°/decade over a frequency range from about one about one decade below the first dominant pole ($f_{p1}$/10) to about one decade above the dominant pole (10 $f_{p1}$). In addition, the phase shift introduced by the zero $f_{z1}$ at 1.57 MHz increases the phase shift by 45°/decade over the frequency range from about $f_{z1}/10$ to about 10 $f_{z1}$ while the phase shift introduced by the parasitic pole at 2.83 MHz decreases the phase shift by 45°/decade over the frequency range from about $f_{p2}/10$ to about 10 $f_{p2}$. Since the location of the zero $f_{z1}$ and parasitic pole $f_{p2}$ are relatively close to one another, the phase shift introduced by the zero $f_{z1}$ and parasitic pole $f_{p2}$ at least partially cancel one another. As a result, the phase shift plot 304 is relatively steady over a frequency range from about $f_{z1}/10$ to about 10 $f_{p2}$. In this embodiment, the phase shift only slightly decreases from about 5 MHz to the ULGF at about 21 MHz such that the phase shift is still at a high enough level to provide an increased phase margin at the ULGF.

Advantageously, the LDO 106 does not need any external components, e.g., a capacitor, for stability reasons. If the LDO 106 is integrated onto the same IC 110 with an associated load 108, the LDO 106 is not required to drive an infinite capacitive load. In addition, the LDO 106 advantageously is stable over a wide range of current levels provided by the LDO 106. For example, in one embodiment, a minimum current level during light load conditions may be 40 nanoamperes (nA) while a maximum current level during heavy load conditions may be 40 milliamperes (mA).

Figure 4:
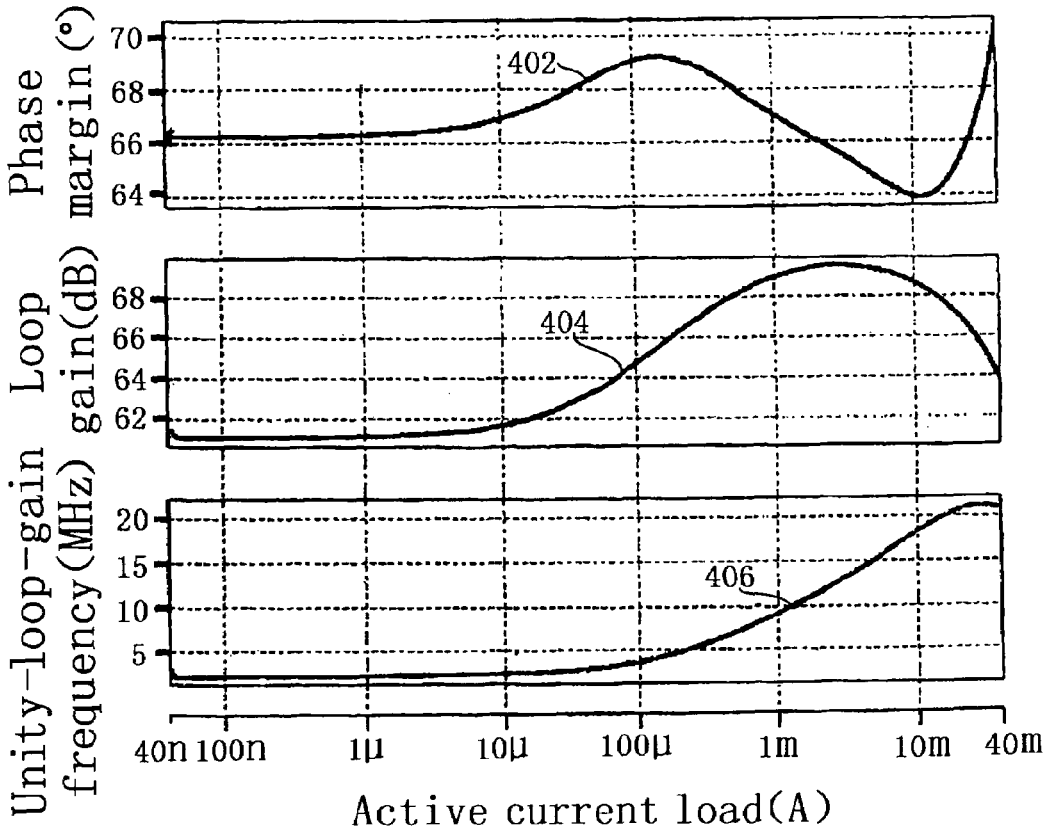
FIG. 4 is a graph of various plots illustrating stability characteristics of the LDO of FIG. 2 as the active load current provided by the LDO varies between a minimum and maximum level.

FIG. 4 illustrates several plots illustrating simulated characteristics of the LDO 106 of FIG. 2 as the active current load provided by the LDO varies from a minimum of 40 nA to a maximum of 40 mA. Plot 402 illustrates a simulated phase margin in degrees over this wide current range. As plot 402 illustrates, the phase margin remains above about 64 degrees over the specified current range. In addition, the phase margin variation during the entire current range is only about 5 degrees from a maximum phase margin of about 69 degrees to a minimum phase margin of about 64 degrees. Plot 404 illustrates a simulated loop gain over the same current range that remains above 61 dB during the entire range. In addition, the loop gain variation during the same range is only about 8.4 dB from a maximum loop gain level to a minimum loop gain level. Finally, plot 406 illustrates the ULGF in MHz over the same current range. The ULGF remains above about 2.2 MHz during the entire range with a maximum of about 21 MHz at about 40 mA.

Figure 5:
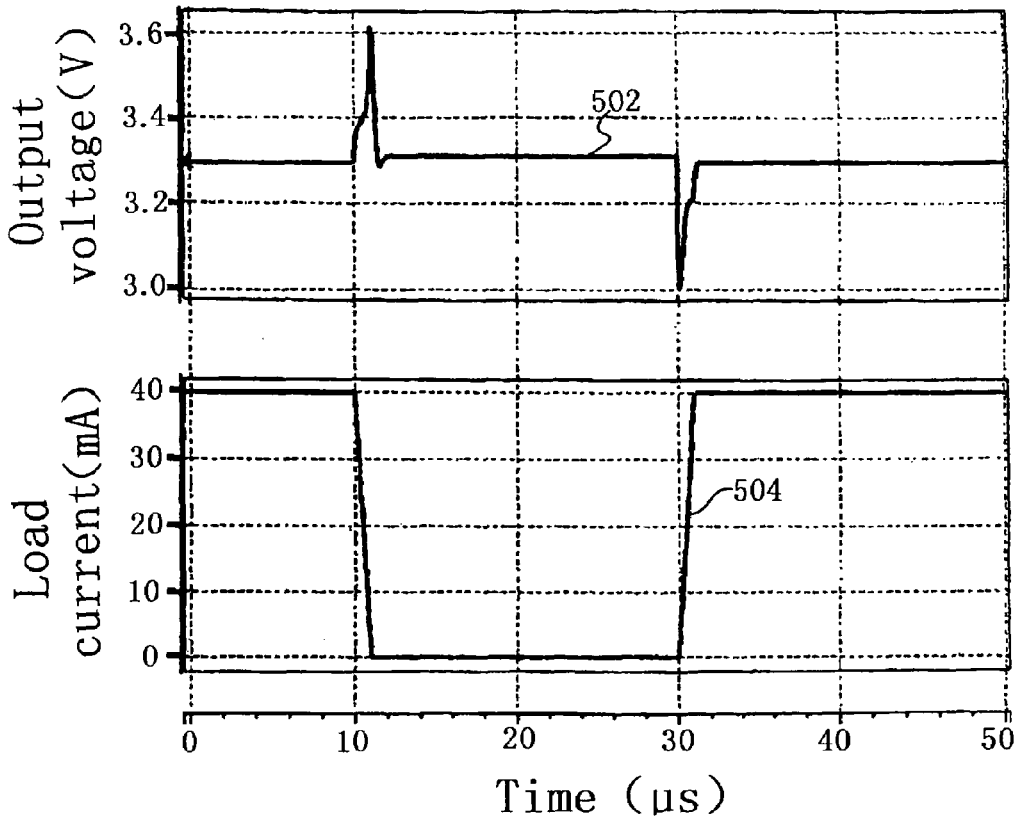
FIG. 5 is a graph illustrating the transient response of the output voltage of the LDO of FIG. 2 as the active load current provided by the LDO varies between a minimum and maximum level.

FIG. 5 illustrates a simulated plot 502 of the regulated output voltage provided by the LDO 106 as the plot 504 of load current toggles between a minimum load current level (40 nA) and a maximum current level (40 mA) to illustrate the transient response of the LDO 106. The simulated output voltage is designed to provide 3.3 volts. The toggling time is about 1 microsecond (μs). As the load current toggles from a maximum of about 40 mA at 10 μs down to about 40 nA at 11 μs, the overshoot of the output voltage is only about 0.3 volts, making the peak value of the output voltage no more than about 3.6 volts. When the output current starts to toggle back up at 30 μs, the associated undershoot of the output voltage is only also about 0.3 volts, making the lowest value of the output voltage no less than about 3.0 volts. In addition, it can be seen that the full-scale switch of the load current only results in a step of about 5 mV on the output voltage.

There is thus provided an LDO comprising a regulating circuit having an input terminal, an output terminal, and a control terminal. The regulating circuit is configured to receive an input signal at the input terminal and provide an output signal at the output terminal in response to a control signal received at said control terminal. The LDO may also comprise an amplifier having a first and second input terminal and an output terminal. The first input terminal of the amplifier may be coupled to a first input path and the output terminal of the amplifier may be coupled to the control terminal of the regulating circuit via a path to provide the control signal. The LDO may further comprise a first compensating path coupled between a first node on the first input path and a first node on the path coupling the output terminal of the amplifier to the control terminal of the regulating circuit, the first compensating path comprising a first compensating capacitor.

An IC comprising such an LDO and an electronic device comprising the IC are also provided. Related methods are also provided. Advantageously, the LDO provides a stable regulated output voltage over a wide range of active load currents. In addition, the LDO does not need any external compensation components. Furthermore, the LDO may be incorporated onto an IC with an associated load. The LDO may also be easily built using any variety of process such as pure digital complimentary metal oxide semiconductor (CMOS) processes, bipolar CMOS processes (biCMOS), and other processes.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A low dropout voltage regulator (LDO) comprising:

a regulating circuit having an input terminal, an output terminal, and a control terminal, said regulating circuit configured to receive an input signal at said input terminal and provide an output signal at said output terminal in response to a control signal received at said control terminal;

an amplifier having a first and second input terminal and an output terminal, said first input terminal coupled to a first input path, said output terminal of said amplifier coupled to said control terminal of said regulating circuit via a path to provide said control signal;

a first compensating path coupled between a first node on said first input path and a first node on said path coupling said output terminal of said amplifier to said control terminal of said regulating circuit, said first compensating path comprising a first compensating capacitor; and a second compensating path coupled between said output terminal of said regulating circuit and a second node on said path coupling said output terminal of said amplifier to said control terminal of said regulating circuit, said second compensating path comprising a second compensating capacitor.

2. The LDO of claim 1, wherein said first input path comprises a resistor.

3. The LDO of claim 2, wherein a feedback network is coupled between said output terminal of said regulating circuit and said second input terminal of said amplifier, wherein a second stage circuit comprises said regulating circuit and said feedback network, and wherein a first dominant pole is introduced in a frequency response plot of said LDO, said first dominant pone given by:

$$f_{pl} = \frac{1}{2\pi[R_S(1+A)C_1 + r_{01}(1+B)C_2]}$$

where $R_S$ is a value of said resistor, A is a voltage gain of said amplifier, $C_1$ is a value of said first compensating capacitor, $r_{O1}$ is an output impedance of said amplifier, B is a voltage gain of said second stage circuit, and $C_2$ is a value of said second compensating capacitor.

4. The LDO of claim 2, wherein said first compensating capacitor and said resistor introduce a zero in a frequency response plot of said LDO, said zero given by:

$$f_{zl} = \frac{1}{2\pi R_S C_1}$$

where $R_S$ is a value of said resistor and $C_1$ is a value of said first compensating capacitor.

5. The LDO of claim 1, wherein said regulating circuit comprised a MOSFET transistor, said input terminal of said regulating circuit comprising a source terminal of said MOSFET transistor, said output terminal of said regulating circuit comprising a drain terminal of said MOSFET transistor, and said control terminal of said regulating circuit comprising a gate terminal of said MOSFET transistor.

6. An integrated circuit comprising:

a load; and at least one low dropout voltage regulator (LDO) for providing a regulated output voltage to said load, said at least one LDO comprising:

a regulating circuit having an input terminal, an output terminal, and a control terminal, said regulating circuit configured to receive an input signal at said input terminal and provide an output signal at said output terminal in response to a control signal received at said control terminal;

an amplifier having a first and second input terminal and an output terminal, said first input terminal coupled to a first input path, said output terminal of said amplifier coupled to said control terminal of said regulating circuit via a path to provide said control signal;

a first compensating path coupled between a first node on said first input path and a first node on said path coupling said output terminal of said amplifier to said control terminal of said regulating circuit, said first compensating path comprising a first compensating; and a second compensating path coupled between said output terminal of said regulating circuit and a second node on said path coupling said output terminal of said amplifier to said control terminal of said regulating circuit, said second compensating path comprising a second compensating capacitor.

7. The integrated circuit of claim 6, wherein said first input path comprised a resistor.

8. The integrated circuit of claim 7, wherein a feedback network is coupled between said output terminal of said regulating circuit and said second input terminal of said amplifier, wherein a second stage circuit comprises said regulating circuit and said feedback network, and wherein a first dominant pole is introduced in a frequency response plot of said LDO, said first dominant pole given by:

$$f_{pl} = \frac{1}{2\pi[R_S(1+A)C_1 + r_{01}(1+B)C_2]}$$

where $R_S$ is a value of said resistor, A is a voltage gain of said amplifier, $C_1$ is a value of said first compensating capacitor, $r_{O1}$ is an output impedance of said amplifier, B is a voltage gain of said second stage circuit, and $C_2$ is a value of said second compensating capacitor.

9. The integrated circuit of claim 7, wherein said first compensating capacitor and said resistor introduce a zero in a frequency response plot of said LDO, said zero given by:

$$f_{zl} = \frac{1}{2\pi R_S C_1}$$

where $R_S$ is a value of said resistor and $C_1$ is a value of saidfirst compensating capacitor.

10. An electronic device comprising:

an integrated circuit, said integrated circuit comprising at least one low dropout voltage regulator (LDO), for providing a regulated output voltage to a load of said integrated circuit, said at least one LDO comprising:

a regulating circuit having an input terminal, an output terminal, and a control terminal, said regulating circuit configured to receive an input signal at said input terminal and provide an output signal at said output terminal in response to a control signal received at said control terminal;

an amplifier having a first and second input terminal and an output terminal, said first input terminal coupled to a first input path, said output terminal of said amplifier coupled to said control terminal of said regulating circuit via a path to provide said control signal;

a first compensating path coupled between a first node on said first input path and a first node on said path coupling said output terminal of said amplifier to said control terminal of said regulating circuit, said first compensating path comprising a first compensating capacitor; and a second compensating path coupled between said output terminal of said regulating circuit and a second node on said path coupling said output terminal of said amplifier to said control terminal of said regulating circuit, said second compensating path comprising a second compensating capacitor.

11. The electronic device of claim 10, wherein said first input path comprises a resistor.

12. The electronic device of claim 11, wherein a feedback network is coupled between said output terminal of said regulating circuit and said second input terminal of said amplifier, wherein a second stage circuit comprises said regulating circuit and said feedback network, and wherein a first dominant pole is introduced in a frequency response plot of said LDO, said first dominant pone given by:

$$f_{pl} = \frac{1}{2\pi[R_S(1+A)C_1 + r_{01}(1+B)C_2]}$$

where $R_S$ is a value of said resistor, A is a voltage gain of said amplifier, $C_1$ is a value of said first compensating capacitor, $r_{O1}$ is an output impedance of said amplifier, B is a voltage gain of said second stage circuit, and $C_2$ is a value of said second compensating capacitor.

13. The electronic device of claim 11, wherein said first compensating capacitor and said resistor introduce a zero in a frequency response plot of said LDO, said zero given by:

$$f_{z1} = \frac{1}{2\pi R_S C_1}$$

where $R_S$ is a value of said resistor and $C_1$ is a value of said first compensating capacitor.

14. A method of compensating a low dropout voltage (LDO) regulator comprising:

introducing a first dominant pole in a frequency response plot of said LDO;

introducing a second parasitic pole in said frequency response plot; and introducing a first zero in said frequency response plot, said first zero resulting in a first phase shift that at least partially cancels with a second phase shift introduced by said second parasitic pole.

15. The method of claim 14, wherein said second parasitic pole occurs at a first frequency level and said first zero occurs at a second frequency level, said second frequency level less than said first frequency level.

* * * * *